US005182013A

United States Patent [19]

Petersen et al.

[11] Patent Number: 5,182,013

[45] Date of Patent: Jan. 26, 1993

[54] NAPHTHENIC ACID CORROSION INHIBITORS

[75] Inventors: Philip R. Petersen, Houston; Frederick P. Robbins, III, Deer Park; William G. Winston, Houston, all of Tex.

[73] Assignee: Exxon Chemical Patents Inc., Linden, N.J.

[21] Appl. No.: 631,422

[22] Filed: Dec. 21, 1990

[51] Int. Cl.[5] ..... C10G 7/10

[52] U.S. Cl. ..... 208/348; 203/7; 106/14.26; 106/14.05

[58] Field of Search ..... 208/348; 203/7; 106/14.26, 14.05

[56] References Cited

U.S. PATENT DOCUMENTS 2,973,316 2/1961 Howland ..... 208/348
3,989,459 11/1976 Nose et al. ..... 203/7

FOREIGN PATENT DOCUMENTS 701194 1/1965 Canada ..... 208/348

OTHER PUBLICATIONS

CA113(16): 135548g, Mar. 9, 1990.

*Primary Examiner*—Theodore Morris
*Assistant Examiner*—David M. Brunsman
*Attorney, Agent, or Firm*—R. L. Graham

[57] ABSTRACT

Naphthenic acid corrosion in refinery distillation units is inhibited by introducing into the units effective amounts of a polysulfide corrosion inhibitor.

7 Claims, No Drawings

NAPHTHENIC ACID CORROSION INHIBITORS

FIELD OF THE INVENTION

This invention relates generally to a process for inhibiting naphthenic acid corrosion in refining operations. In one aspect, the invention relates to the use of a polysulfide corrosion inhibitor for inhibiting naphthenic acid corrosion in crude distillation units and furnaces.

BACKGROUND OF THE INVENTION

Corrosion problems in petroleum refining operations associated with naphthenic acid constituents in crude oils have been recognized for many years. Such corrosion is particularly severe in atmospheric and vacuum distillation units at temperatures between 400 degrees F. and 790 degrees F. Other factors that contribute to the corrosivity of crudes containing naphthenic acids include the amount of naphthenic acid present, the presence of sulfides, the velocity and turbulence of the flow stream in the units, and the location in the unit (e.g., liquid vapor interface).

Efforts to minimize or prevent the naphthenic corrosion have included the following approaches:

(a) blending of higher naphthenic acid content oil with oil low in naphthenic acids;

(b) neutralization and removal of naphthenic acids from the oil; and (c) use of corrosion inhibitors.

The problems caused by naphthenic acid corrosion in refineries and the prior art solutions to that problem have been described at length in the literature, the following of which are representative:

1) "Naphthenic Acid Corrosion in Crude Distillation Units," by R. L. Piehl, published in Materials Performance, January, 1988;

2) "Naphthenic Acid Corrosion, An Update of Control Methods," by Scattergood et al, Paper No. 197, presented in Corrosion/87, San Francisco, Mar. 9-13, 1987; and 3) "Studies Shed Light on Naphthenic Acid Corrosion," by J. Gutzeit, published in the Oil and Gas Journal, Apr. 5, 1976.

Because these approaches have not been entirely satisfactory, the accepted approach in the industry is to construct the distillation unit, or the portions exposed to naphthenic acid corrosion, with resistant metals such as high quality stainless steel or alloys containing higher amounts of chromium and molybdenum. However, in units not so constructed there is a need to provide corrosion inhibition treatment against naphthenic acid. The prior art corrosion inhibitors for naphthenic acid environments include amine and amide based corrosion inhibitors. As stated in the NACE publication (Paper No. 197) identified above, these corrosion inhibitors are relatively ineffective in the high temperature environment of naphthenic acid oils.

SUMMARY OF THE INVENTION

It has surprisingly been discovered that organic polysufides are effective naphthenic acid corrosion inhibitors for refinery distillation units. The corrosion inhibitor may be introduced into the oil upstream of the furnaces to provide protection for the furnace tubes as well as the distillation units. Also, the inhibitor may be added to a reflux recycle stream that is returned to the atmospheric or vacuum distillation tower above the area that is experiencing naphthenic acid corrosion.

This treated liquid will then descend in the tower, protecting all metal surfaces it comes into contact with.

The amount of the corrosion inhibitor in the oil should be sufficient to provide as much protection as possible against corrosive effects of the acids in the oil. The economics, however, dictate that the percent protection with reasonable levels of treatment is greater than about 40% and preferably from 50 to 80%. (Percent protection is defined below).

The concentration of the corrosion inhibitor will generally range from 10 to 5000 ppm, preferably between to 25 to 2000 ppm and most preferably between 100 and 1500 ppm, based on the weight of the feed stream. The organic polysufides are particularly effective in the treatment of crude oil containing corrosive amounts of naphthenic acids and hydrogen sulfide.

DESCRIPTION OF THE PREFERRED EMBODIMENTS

Many crude oils contain corrosive amounts of naphthenic acid. The concentration of naphthenic acid in crude oil is expressed as an acid neutralization number or acid number which is the number of milligrams of KOH required to neutralize the acidity on one gram of oil. Crude oils with acid numbers of about 1.0 and below are considered low to moderately corrosive. Crudes with acid numbers greater than 1.5 are considered corrosive and require treatment or the use of corrosion resistant alloys.

In the distillation refining of crude oils, the crude oil is passed successively through a furnace, and one or more fractionators such as an atmospheric tower and a vacuum tower. In most operations, naphthenic acid corrosion is not a problem at temperatures below about 400 degrees F. As mentioned previously, the amine and amide corrosion inhibitors are not effective at these high temperatures and the other approaches for preventing naphthenic acid corrosion such as neutralizing present operational problems.

It should be observed that the term "naphthenic acid" includes mono and di basic carboxylic acids and generally constitutes about 50 percent by weight of the total acidic components in crude oil. Naphthenic acids may be represented by the following formula:

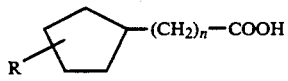

Where: R is an alkyl or cycloalkyl and n ranges generally from 2 to 10.

Many variations of this structure and molecular weight are possible.

Naphthenic acids are corrosive between the range of about 210 degrees C. (400 degrees F.) to 420 degrees C. (790 degrees F.). At the higher temperatures the naphthenic acids are in the vapor phase and at the lower temperatures the corrosion rate is not serious. The corrosivity of naphthenic acids appears to be exceptionally serious in the presence of sulfides, such as hydrogen sulfide.

It has been discovered that by incorporating an effective amount of organic polysulfide, the corrosivity of naphthenic acids at the elevated temperatures is substantially reduced, even in the presence of hydrogen sulfide.

The polysulfides usable in the present invention have the following formula:

R—Sx—R'

Where: R and R' are each an alkyl group containing from 6 to 30 carbon atoms, or cycloalkyl group containing from 6 to 30 carbon atoms and 1 to 4 rings or an aromatic group; and x ranges from 2 to 6.

The preferred polysulfides are those in which the R and R' groups are the alkyl and cycloalkyl groups. The most preferred polysulfides are those wherein both R and R' groups are the same (e.g., alkyl groups or cycloalkyl groups).

The sulfur content of the polysulfide ranges from 10 to 60%, preferably 25 to 50%, by weight. The preferred polysulfides include the following: olefin polysulfides and terpene polysulfides or mixtures thereof.

The molecular weight of the polysulfides useable in the method of the present invention may range from 200 to 800, preferably 300 to 600.

The organic polysulfides can be prepared by processes well known in the art. See for example U.S. Pat. Nos. 2,708,199 and 3,022,351 and 3,038,013, the disclosures of which are incorporated herein by reference. Also, see Chapter 22 entitled "Inorganic and Organic Polysulfides" of *Sulfur in Organic and Inorganic Chemicals*, by Alexander Senning, published by Marcell Dekker (1972).

The polysulfides are soluble in a variety of oils and therefore may be introduced as an oil soluble package. Preferred carriers are aromatic solvents such as xylenes and heavy aromatic naphtha. Other additives such as surfactants or other types of corrosion inhibitor may be included in the package. Generally, the polysulfide will constitute from 20 to 70 weight % of the package.

LABORATORY EXPERIMENTS

A series of laboratory experiments were conducted to demonstrate the effectiveness of the organic polysulfides as naphthenic acid corrosion inhibitors.

Test Equipment:

1. temperature controlled autoclave
2. cylindrical coupons (mild steel)
3. means to rotate the coupon to provide a peripheral velocity in excess of 10 FPS Materials:

1. lubricating oil with naphthenic acid added to provide a neutralization no. of 11.
2. nitrogen in the vapor space.

The following samples were prepared and tested:

| Sample | Corrosion Inhibitor | Concentration (PPM) |
|---|---|---|
| A-1 | Organic polysulfide' | 1000 |
| A-2 | Organic polysulfide' | 500 |
| A-3 | Organic polysulfide' | 250 |
| B-1 | Organic polysulfide" | 1000 |
| B-2 | Organic polysulfide" | 500 |
| B-3 | Organic polysulfide" | 250 |
| X | Prior Art Corrosion Inhibitor"' | 1000 |

'Aliphatic Polysulfide
"Alicyclic Polysulfide
"'Imidazoline

Table I presents the results of the corrosion coupon tests. The vapor space contained only nitrogen. The results are based on the average of two coupons exposed for a period of 18 hours at a temperature of 400 degrees F. The percentage protection is based on the following calculation:

$$\% \text{ Protection} = \frac{Wo - Wi}{Wo} \times 100$$

Wo = weight loss of untreated blank coupon
Wi = weight loss of inhibited coupon

TABLE I

| Sample | Corrosion Inhibitor Concentration (PPM) | Protection |
|---|---|---|
| A-2 | 500 | 31 |
| B-1 | 1000 | 67 |
| B-2 | 500 | 31 |
| X | 1000 | 15 |

A comparison of the organic polysulfide performance with the commercial amine corrosion inhibitor reveals that the polysulfides more than doubled the percent protection at half the concentration. At comparable concentrations the organic polysulfide increased percent protection by more than 400% (Sample B-1 versus Sample X tests).

Table II presents the results of corrosion coupon tests carried out for 18 hours at 400 degrees F. where the vapor phase contained nitrogen with 4 percent hydrogen sulfide.

TABLE II

| Sample | Corrosion Inhibitor Concentration (PPM) | % Protection |
|---|---|---|
| Blank | 0 | 0 |
| A-1 | 1000 | 58 |
| A-2 | 500 | 63 |
| A-3 | 250 | 0 |
| B-1 | 1000 | 80 |
| B-2 | 500 | 0 |
| B-3 | 250 | 0 |
| X | 1000 | 0 |

In the severe corrosive environment of naphthenic acid and hydrogen sulfide, the commercial amine corrosion inhibitor gave no protection. The organic polysulfides above 250 ppm, however, gave surprisingly good protection (58–80%). It should be noted that the scattering of data are common in corrosion tests. It should be observed that laboratory coupon tests are generally carried out at higher concentrations than those used in practice. Although test with Samples A-3 and B-3 (250 ppm) did not demonstrate protection in the laboratory, concentrations at this range and even smaller would be expected to provide protection because of the continuous chemical injection with time can build up a protective film on the metal.

Table III presents the results of corrosion coupon tests for 18 hours at a temperature of 500 degrees F. wherein the vapor phase contained nitrogen with 4 percent hydrogen sulfide.

TABLE III

| Sample | Corrosion Inhibitor Concentration (PPM) | % Protection |
|---|---|---|
| Blank | — | 0 |
| A-1 | 1000 | 27 |
| A-2 | 500 | 46 |
| B-1 | 1000 | 37 |
| B-2 | 500 | 70 |

The organic polysulfides provided reasonable protection under the most severe test conditions (500 degrees F. in the presence of hydrogen sulfide.)

The following conclusions can be drawn from the test results presented in Tables I–III:

1. The commercial amine corrosion inhibitor (Sample X gave practically no protection against naphthenic acid corrosion in the presence or absence of hydrogen sulfide.)
2. The organic polysulfide corrosion inhibitors were far more effective inhibitors than the commercial inhibitor and exhibited activity up to temperatures of 500 degrees F.

Although the reasons for the improved results are not fully understood, it is believed that the high sulfur content of the organic polysulfides contributes to inhibition properties by forming a more protective iron sulfide/-polysulfide film on the metal surface.

What is claimed is:

1. A method of inhibiting naphthenic acid corrosion of crude oil in a crude oil distillation unit carried out at a temperature above 400 degrees F., said method comprising introducing into the oil an effective amount of an organic polysulfide to inhibit naphthenic acid corrosion, said polysulfide having the following formula:

$$R—(S)x—R'$$

where: R and R′ are each alkyl groups having from 6 to 30 carbon atoms, or a cycloalkyl group having from 6 to 30 carbon atoms, or an aromatic group, and may be the same or different; and x ranges from 2 to 6.

2. The method of claim 1 wherein the concentration of the organic polysulfide in the oil stream is between 25 to 2000 ppm.

3. The method of claim 2 wherein the R and R′ are each alkyl or cycloalkyl groups.

4. The method of claim 1 wherein the percent sulfur in the polysulfide comprises from 10 to 60 wt % of the polysulfide.

5. A method of inhibiting naphthenic acid corrosion in a vacuum distillation unit which comprises continuously introducing into the vacuum distillation unit an effective amount of an organic polysulfide within the concentration range of 10 ppm to 5000 ppm based on the feed stream into the unit to substantially reduce the naphthenic acid corrosion in the unit.

6. A method of treating a refinery distillation tower for processing oil containing corrosive amounts of naphthenic acid and hydrogen sulfide carried out at temperatures within the range of 400 to 790 degrees F., said method comprising the step of introducing into the oil processed through the tower inhibiting amounts of an organic polysulfide having the following formula:

$$R—(S)x—R'$$

where: R is and R′ are each al alkyl or cycloalkyl group containing from 6 to 30 carbon atoms; and x ranges from 2 to 6.

7. The method of claim 6 wherein the concentration of organic polysulfides in the oil is between 100 to 1500 ppm based on the weight of the oil.

* * * * *